United States Patent [19]

Tokuda

[11] Patent Number: 4,829,292

[45] Date of Patent: May 9, 1989

[54] METHOD FOR DISPLAYING BOX CURSORS

[75] Inventor: Shigeo Tokuda, Fujisawa, Japan

[73] Assignee: International Business Machines Corp., Armonk, N.Y.

[21] Appl. No.: 869,869

[22] Filed: Jun. 2, 1986

[30] Foreign Application Priority Data

Aug. 20, 1985 [JP] Japan ..... 61-181181

[51] Int. Cl.[4] ..... G09G 1/16

[52] U.S. Cl. ..... 340/709; 340/706

[58] Field of Search ..... 340/709, 706, 734, 724

[56] References Cited

U.S. PATENT DOCUMENTS

| | | | |
|---|---|---|---|
| Re. 31,200 | 4/1983 | Sukonick et al. | 340/709 |
| 3,659,205 | 4/1972 | Baer et al. | 340/709 |
| 3,868,673 | 2/1975 | Mau et al. | 340/709 |
| 4,093,221 | 6/1978 | Dash | 340/734 |
| 4,190,835 | 2/1980 | Buynak | 340/709 |
| 4,400,780 | 8/1983 | Nagao et al. | 340/734 |
| 4,495,491 | 1/1985 | Postl | 340/709 |
| 4,628,444 | 12/1980 | Nozawa et al. | 340/709 |

*Primary Examiner*—Donald J. Yusko
*Assistant Examiner*—Alvin Oberley
*Attorney, Agent, or Firm*—C. Lamont Whitham; Michael E. Whitham

[57] ABSTRACT

Box cursors consisting of lines of identical thickness are displayed using a bit inverting technique so that overlapped portions of the cursors may be differentiated. Masks are prepared, one for each of the box cursors, which have patterns which, when exclusive ORed, result in a pattern including 1 bits. The box cursors are generated having lines corresponding to respective ones of the masks. Thus, even though box cursors may overlap on the display, the side or sides of the overlapping cursors will be displayed as a pattern of pel points corresponding to the pattern including 1 bits.

2 Claims, 4 Drawing Sheets

FIG. 1
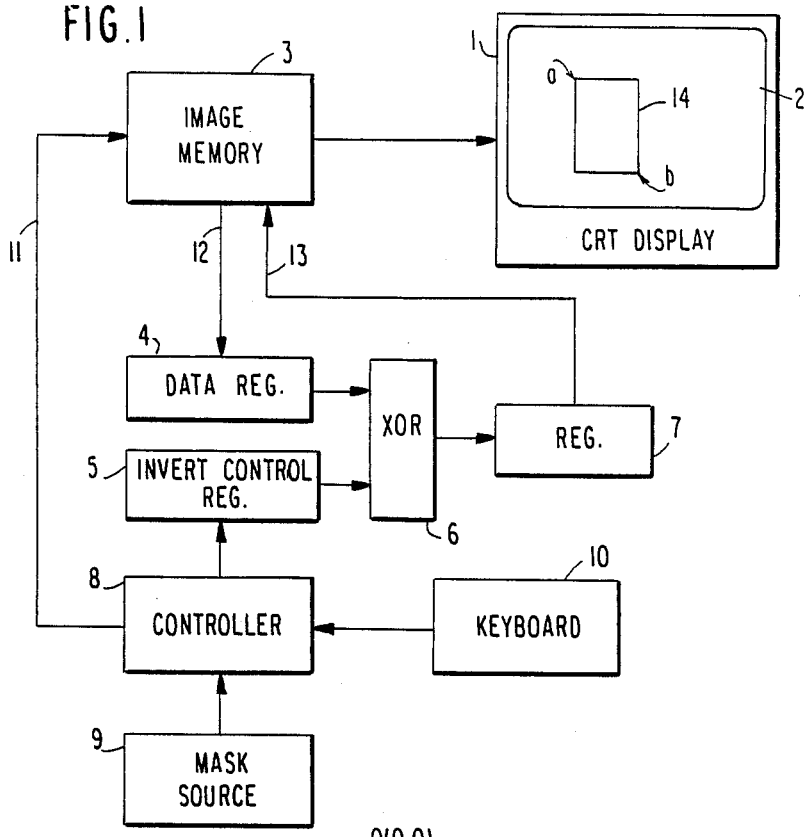
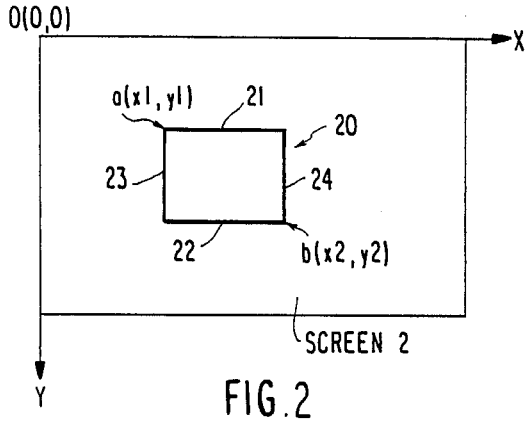
FIG. 2
| MASK | BIT PATTERN |
|---|---|
| A | 1 0 |
| B | 0 1 |
| C | 1 0 1 0 |
| D | 0 1 0 1 |
| E | 1 1 0 0 |
| F | 0 0 1 1 |
| G | 1 0 0 |
| H | 0 1 0 |
| I | 0 0 1 |
| J | 1 1 1 1 |
FIG. 3

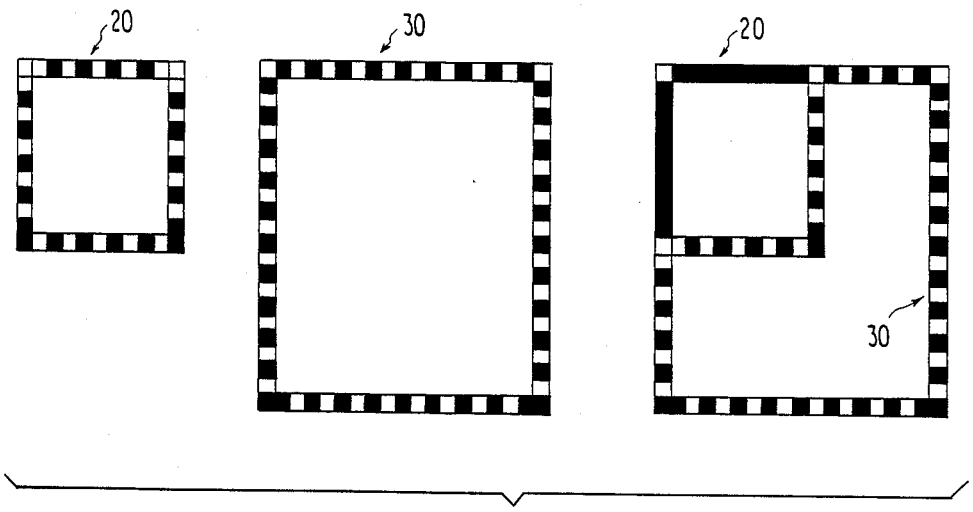
FIG. 5
FIG. 6
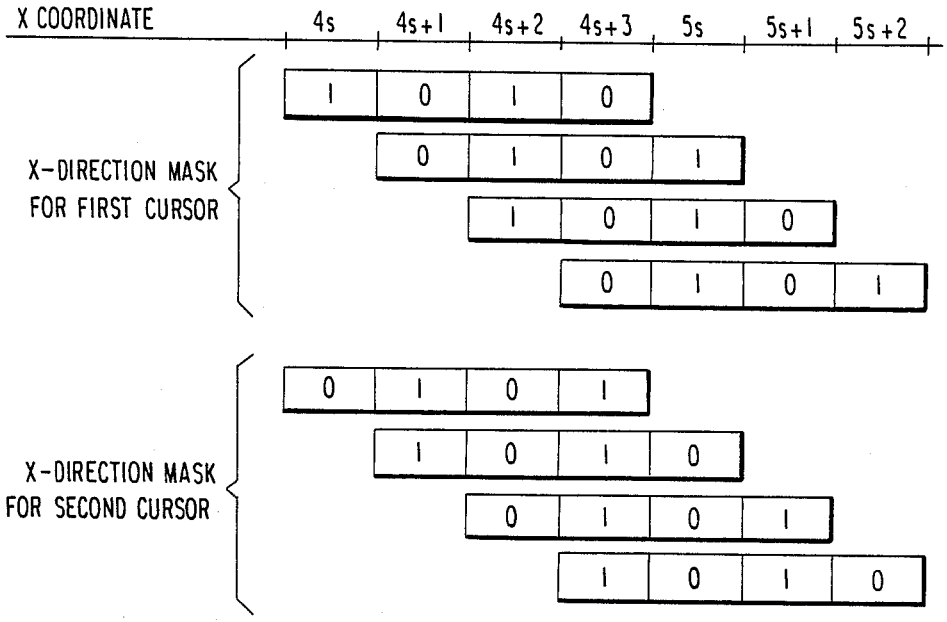

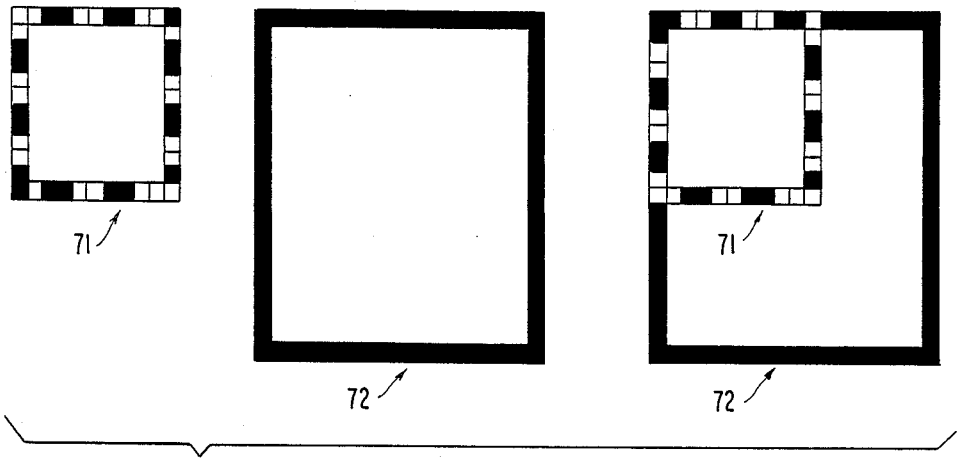
FIG. 7
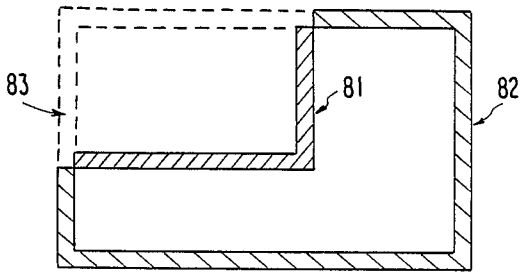
FIG. 8
PRIOR ART
FIG. 9
PRIOR ART
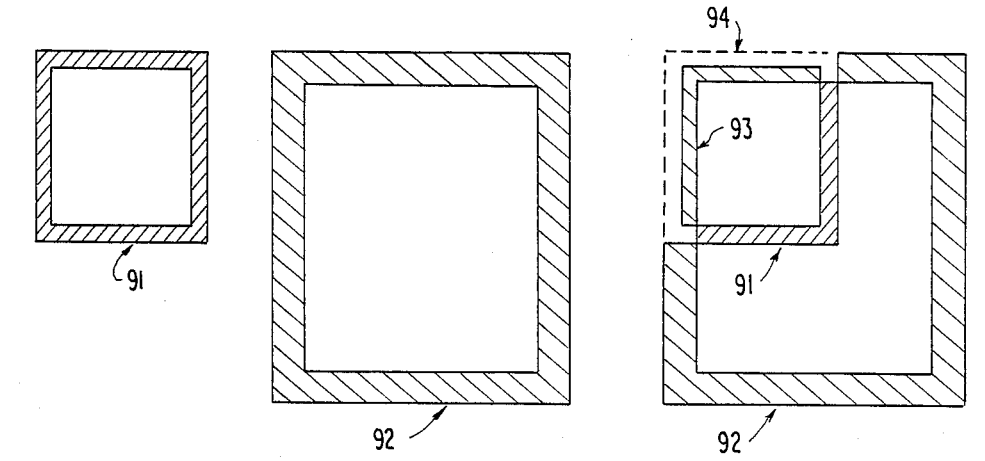

METHOD FOR DISPLAYING BOX CURSORS

FIELD OF THE INVENTION

This invention relates to a method for displaying at least two box cursors in a display apparatus with a bit inverting technique.

BACKGROUND OF THE INVENTION

In the case where it is required to provide some processing at a desired area of an image displayed on a screen of a display apparatus, it is common practice to display a rectangular frame, called a box cursor, for defining the area. It is convenient to display the box cursor by inverting specific bits of those representing the image. The reason is that, by inverting again the specific bits inverted for displaying the box cursor, the box cursor can be easily removed and the original image at the position where the box cursor is displayed can be restored.

Now, it is often required to display two box cursors. For example, two box cursors might be used where a portion of an image in one box cursor is moved to an area within another cursor, either as it is or by enlargement. Usually, two box cursors consist of sides or lines with same thickness, so that, if they overlap partially with each other, the overlapped portion is erased. That is, the bit inverting operation is performed twice for the overlapped portion, so that it becomes in a state where no bit inverting operation is performed. For example, as shown in FIG. 8, the overlapped portion 83 of two box cursors 81 and 82 is erased.

A prior art technique dealing with such problem of erasure is disclosed in pages 649–650 of IBM Technical Disclosure Bulletin, Vol. 27; No. 1B, June 1984. That technique is characterized in that, as shown in FIG. 9, the lines of two box cursors are arranged to have different thicknesses (widths). For example, one box cursor 91 is represented by lines with a thickness of one bit (pel), while the other box cursor 92 is represented by lines with a thickness of two bits. Thus, even if two box cursors overlap with each other as shown, and an overlapped portion is erased, a non-overlapped area 93 is left for the box cursor 92 consisting of thicker lines, so that the function for defining the region is maintained to some extent.

In the prior art technique which was two box cursors which differ in line thickness, the apparent size of the box cursors varies slightly at or near a location where they overlap as shown in FIG. 9. That is, a portion 94 of the thinner box cursor 91 overlaps the thicker box cursor 92 and is erased. Instead, a remaining portion 93 of the thicker box cursor is displayed as if it is a part of the thinner box cursor 91 to provide the impression that the latter is slightly reduced. However, if the overlapped area is near the inside of the box cursor 92, the box cursor 91 is displayed such that it is slightly enlarged. If the lines for both box cursors are relatively thin, the display does not provide so much of an unnatural impression. However, if they are relatively thick, the unnatural impression becomes significant.

Also, in the prior art technique, if the number of box cursors to be displayed simultaneously is more than two, it is required to display the third and fourth box cursors in lines that are to be successively thicker. These cursors are unshapely and not practical.

SUMMARY OF THE INVENTION

The invention intends to eliminate the above-mentioned problems in the prior art technique and to prevent erasure of the overlapped portion by using at least two box cursors consisting of lines of identical thickness.

To this end, the method for displaying the box cursors according to the invention is characterized in that operations for inverting bits for displaying two box cursors are performed by using masks with different bit patterns.

The first method of the invention comprises steps of preparing a first mask consisting of a bit pattern which includes at least one bit 0 and at least one bit 1, and a second mask consisting of a bit pattern which has a complementary (or exclusive) relationships with the bit pattern of said first mask, inverting bits for displaying the first box cursor by using one of said first and second masks, and inverting bits for displaying the second cursor by using the other mask.

The second method of the invention comprises steps of inverting bits for displaying the first and second box cursors by using a first mask consisting of a bit pattern which includes at least one bit 0 and at least one bit 1, and a second mask consisting of a bit pattern which includes bit 1 only.

BRIEF DESCRIPTION OF THE DRAWINGS

FIG. 1 is a schematic block diagram of a display apparatus for embodying the method for displaying cursors of the invention.

FIG. 2 is a diagram showing a cursor in an X—Y coordinate system-defined for a display screen.

FIG. 3 is a view showing bit patterns for various masks.

FIG. 5 is a view illustrating two cursors displayed according to the first method. FIG. 6 is a view indicating relations between the X coordinate values and the X direction masks for two cursors. FIG. 7 is a view illustrating two cursors displayed according to the second method of the invention. FIGS. 8 and 9 are views illustrating two cursors displayed according to the prior art technique, respectively.

DETAILED DESCRIPTION OF THE DRAWINGS

Figure 4:
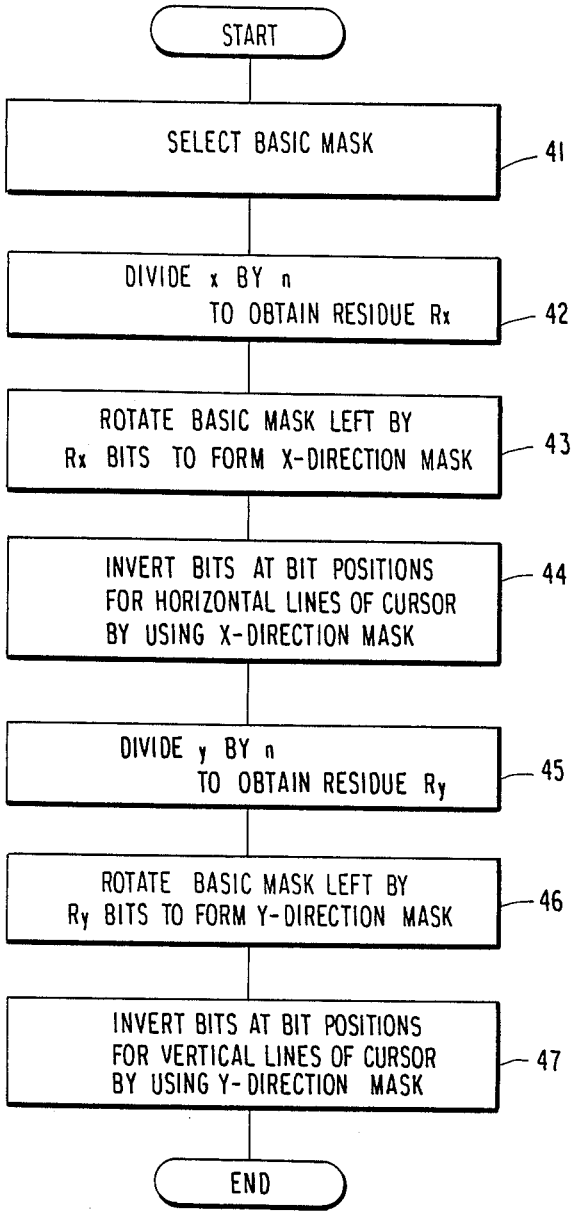
FIG. 4 is a flowchart of operation sequence according to the first method of the invention.

FIG. 1 shows a schematic diagram display apparatus embodying the invention. A CRT display 1 and an image memory 3 are well-known means. An image based on image data stored in the image memory 3 is displayed on a display screen 2 of the CRT display 1. Defined on the display screen 2 are a plurality of pel points for displaying a plurality of pels of the image, while the image memory 3 has a plurality of bit positions at least corresponding to the pel points on the display screen 2.

The display screen 2 also displays a box cursor (hereinafter called simply "cursor") as indicated by a reference numeral 14. The cursor 14 is a rectangular frame for specifying a desired area of the image. The image area within the frame is selected for processing such as a movement or enlargement of the image area. The cursor 14 is displayed according to an operation by an operator using an external apparatus, for example, a specific key on a keyboard 10. At that moment, the operator is required to provide position specifying information through the keyboard 10 indicating a desired display position for the cursor 14. The position specifying information usually includes coordinates for diagonal points a and b of the cursor 14.

The cursor 14 is displayed by inverting bits at a group of bit positions in the image memory 3 corresponding to a group of pel points for displaying the cursor. The inversion of bits can be performed by an exclusive OR operation between data bits from the image memory 3 and control bits of- binary one. Thus, in the circuit arrangement as shown, a controller 8 supplies an address through a line 11 to read bit for a specific bit position to a data register 4 through a line 12. On the other hand, an invert control register 5 is loaded with a control bit 1 and feeds the resulting bit of the exclusive OR to a register 7. A bit in the register 7 is written in the image memory 3 through a line 13 at a position where the original data bit was stored. The image memory 3 is not limited to a type performing access bit by bit, but may be of a type performing access by plural bits. In case of the latter type, it is required to load control data consisting of a plurality of bits in the invert control register 5.

The invention intends to use a plurality of different masks for inverting the bits in displaying a plurality of cursors consisting of lines of identical thickness. The masks are prepared in a mask source 9. The controller 8 has functions to selectively fetch a mask and load it in the invert control register 5 as it is or after appropriate modification. The controller 8 may be realized as a microprocessor provided with microprograms for various functions.

Although the invention can be applied to simultaneously displaying any number of cursors more than one, a case for displaying two cursors is discussed for convenience of description. Also, it is assumed that a plurality of pel points on the display screen 2 are specified by X-Y coordinates (x, y), the origin 0 of which is a pel point at the upper left corner of the display screen 2.

Required for embodying the first method of the invention are a plurality of basic masks consisting of bit patterns having complementary (or exclusive) relations with each other. Generally, the number of bits n constituting a mask may be equal to or larger than the number of cursors or masks to be displayed, and $n \geqq 2$ in displaying two cursors. Therefore, masks A and B; C and D; or E and F as exemplified in FIG. 3 may be used as two basic masks. In the following, it is assumed to use the masks C and D.

Generally, in the first method, the basic masks are not used as they are for inverting bits, but are required to be used after they are modified through rotation. The amount of the rotation is determined according to the coordinates of a pel point at the upper left corner a, that is the reference point for a cursor to be displayed. FIG. 4 is a flowchart showing an example of an operational sequence for displaying one cursor by the bit inversion accompanying such mask rotation. The operation sequence is described in detail by referring to FIGS. 2 and 4.

First, in FIG. 2, it is assumed that the first cursor, indicated by the reference numeral 20 is desired to be displayed. The first cursor 20 consists of sides or lines 21, 22, 23 and 24. The coordinates for pel points a and b at the upper left corner and the lower right corner are assumed to be (x1, y1) and (x2, y2), respectively. In a step 41 of FIG. 4, the mask C is selected as the basic mask for the first cursor 20 from the above-mentioned masks C and D (FIG. 3). In the next step 42, a residue Rx is obtained by dividing the X coordinate value $x=x1$ of the pel point a as the reference point by the number of bits $n=4$ of the mask C. Then, an X direction mask is formed by rotating the bit pattern of mask C to the left by Rx (step 43). The bit inversion is performed for displaying the horizontal lines 21 and 22 of the first cursor 20 by using the X direction mask (step 44). Namely, the bit inversion is performed by sequentially reading data bits from a group of bit positions in the image memory 3 (FIG. 1) corresponding to the line 21 and by repeatedly applying the X direction mask. However, the data bit only related to bit for the X direction mask is inverted. In steps 45, 46 and 47 similar to the above-mentioned steps 42, 43, and 44, the process is performed for displaying vertical lines 23 and 24 of the first cursor 20. Namely, a mask in the Y direction is formed by rotating the cursor C to the left by Ry bits. The Ry is a residue of $y=y1$. By using it, the inversion is performed for bits at bit positions corresponding to the vertical lines 23 and 24.

Similarly, the second cursor is also displayed according to the operation sequence of FIG. 3. However, in this case, it is required to select the mask D (FIG. 3) as the basic mask.

The operation sequence of FIG. 4 is a mere example, and the order of operation steps may be changed. For example, it is possible to execute first the steps for displaying the vertical lines and then the steps for displaying the horizontal lines. Also, it is possible to perform first the steps relating to the generation of the mask for X and Y directions followed by the steps for bit inversion for displaying the vertical and horizontal lines.

FIG. 5 shows examples of the first and second cursors 20 and 30 thus displayed and a state where they are overlapped. It shows only the display of the cursors ignoring the image data bits for convenience of description. Also, each small square represents one pel. And, it is assumed that the black square corresponds to bit 1 and the white square corresponds to bit 0. According to the above-mentioned method of the invention, the black pels (bit 1) of two cursors do not overlap in principle (except for those at a corner where they may overlap), and thus the overlapped lines never disappear. In the following, this is described in more detail.

FIG. 5 shows relation between X coordinate values and the X direction mask which is generated when the X coordinate values x of the pel at the upper left that is the reference point for displaying each cursor (the pel point a for the first cursor shown in FIG. 1) is 4s, 4s+1, 4s+2 or 4s+3, i.e. when the residue of x'n is 0, 1, 2, or 3, wherein s=0, 1, 2 . . . . For example, if the X coordinate value x of the reference point for the first cursor is 4s, the X direction mask has the same bit pattern of 1010 as the mask C. The X direction mask is repeatedly used for inverting bits of bit positions corresponding to sequential pel points specified by the X coordinate values after $x=4s$. If the X coordinate value x of the reference point is $4s+1$, the X direction mask has a bit pattern of 0101 that is the mask C rotated to the left by one bit. It is used for processing bits of bit positions corresponding to sequential pel points specified by the X coordinate values after $x=4s+1$. Similarly, the X direction mask for the second cursor is generated as shown according to change of the reference point. As clearly seen from the relation between the X direction masks for two cursors and the X coordinate values, bit 1 of the X direction mask for the first cursor is always applied to pel points having even-numbered X coordinate values, while the bit 1 of the X direction mask for the second cursor is always applied to pel points having odd-numbered X coordinate values. Therefore, the black pels of two cursors never overlap with each other and erasure of the horizontal lines caused by the overlapping does not occur.

The relationship between the X coordinate values and the X direction masks shown in FIG. 5 can be applied to the relationship between the Y coordinate values and the Y direction masks. And, therefore, erasure of the vertical lines caused by the overlapping does not occur.

According to the operational sequence of FIG. 4, performed for bits of bit positions corresponding to the four corners of the cursor, are two operations, that is, the operation by the X direction mask and that by the Y direction mask. To avoid such duplicated operations, it may be possible to inhibit application of the mask bit to the first and last bits in writing the vertical lines by the Y direction mask.

The example of the display in FIG. 5 is for such a case where both of the X and Y coordinate values of the reference point are even numbers and the duplication of bit processing for the corners of cursor is not inhibited.

Although, in the generic example hereinabove described, the X and Y direction masks are generated by rotating the basic mask, it is possible to arrange to use the basic mask as it is without performing the rotation. Namely, the rotation becomes unnecessary by allowing to select only such pel point both the X and Y coordinate values of which are multiples of the number of bits n of the mask as the reference point corresponding to the upper left corner of the box cursor.

Although the above example is for displaying two box cursors, it is possible to arrange to display more than two cursors. For example, to display three cursors, it is sufficient to use three complementary bit patterns such as the masks G, H and I of FIG. 3.

Another embodiment is hereinafter described for displaying two cursors according to the second method of the invention. Required for the embodiment of this method are a first mask consisting of a bit pattern which includes at least one bit 0 and at least one bit 1, and a second mask consisting of a bit pattern which includes at least one bit 1 only. For example, the mask F in FIG. 3 is used for the first mask, and the mask J for the second mask. FIG. 7 shows two cursors 71 and 72 being displayed in this case. A portion where the two cursors overlap has a pattern that is the reversed pattern of the cursor 71, but it is not completely erased, so that the function defining a region is perfectly maintained. In the case of this method, it is not required to rotate the masks F and J as the basic masks according to the coordinate of the reference point of cursor, and they are usable for inverting the bits as they are.

Although, in the embodiments hereinabove described, each cursor consists of lines of thickness of one pel (bit), the invention is not so limited, but can be applied to cursors consisting of lines of any thickness. In such case, it is sufficient to repeat the bit inversion operation to obtain any desired thickness.

The invention enables one to effectively prevent erasure of the overlapped portion of cursors even if the cursors overlap with each other. Also, the present invention completely eliminates the problem of shifting of the overlapped portion encountered in the prior art making the thickness of the lines of cursors different for every cursor and, it is best suited for displaying a number of cursors.

I claim:

1. A method for displaying at least two box cursors consisting of lines of identical thickness in a display apparatus having a screen on which a plurality of pel points are defined in a matrix fashion and a storage means comprising a plurality of bit positions corresponding to said pel points for storing plural bits representing an image to be displayed, said method comprising the steps of:

(a) preparing a first-mask consisting of a bit pattern which includes art least one bit 0 and at least one bit 1, and a second mask consisting of a bit pattern which has a complementary relation with the bit pattern of said first mask, the number of bits in each mask being n which is an integer larger than 1 and each position information includes coordinates (x,y) of a pel point at which a predetermined corner of each box cursor to be displayed in an X-Y coordinate system defined with respect to said screen;

(b) inverting bits at a group of bit positions in said storage means by using one of said first and second masks, said bit positions being selected according to a first position information designating a desired display position of a first box cursor on said screen; and (c) inverting bits at a group of bit positions in said storage means by using the other mask, said bit positions being selected according to a second position information designating a desired display position of a second box cursor on said screen;

said inverting steps (b) and (c) including the operation for inverting bits at bit positions corresponding to lines of each box cursor in the X direction by using said mask after rotating it in a predetermined direction by a number of bits determined by a residue obtained by x/n and operation for invertion bits at bit positions corresponding to lines if each box corner in the Y direction by using said mask after rotating it in a predetermined direction by number of bits determined by a residue obtained by y/n.

2. The method of claim 1, wherein said step (b) includes an operation for modifying said one mask according to said first position information and said step (c) includes an operation for modifying said other mask according to said second position information.

* * * * *